US009756713B2

(12) United States Patent
Liechti et al.

(10) Patent No.: US 9,756,713 B2
(45) Date of Patent: Sep. 5, 2017

(54) METHOD AND CONTROL UNIT FOR OPERATING A PLASMA GENERATION APPARATUS

(71) Applicant: OERLIKON METCO AG, WOHLEN, Wohlen (CH)

(72) Inventors: Florian Liechti, Meisterschwanden (CH); Albert Friedery, Berlingen (CH); Hartmut Koschnitzke, Winterthur (CH); Rene Groeber, Dintikon (CH)

(73) Assignee: OERLIKEN METCO AG, WOHLEN, Wohlen (CH)

( * ) Notice: Subject to any disclaimer, the term of this patent is extended or adjusted under 35 U.S.C. 154(b) by 0 days.

(21) Appl. No.: 14/648,426

(22) PCT Filed: Nov. 27, 2013

(86) PCT No.: PCT/EP2013/074851
§ 371 (c)(1),
(2) Date: May 29, 2015

(87) PCT Pub. No.: WO2014/086636
PCT Pub. Date: Jun. 12, 2014

(65) Prior Publication Data

US 2015/0319834 A1 Nov. 5, 2015

(30) Foreign Application Priority Data

Dec. 4, 2012 (EP) ..... 12195367

(51) Int. Cl.
*H05H 1/30* (2006.01)
*H05H 1/00* (2006.01)
*H05H 1/36* (2006.01)

(52) U.S. Cl.
CPC ..... *H05H 1/30* (2013.01); *H05H 1/0081* (2013.01); *H05H 1/36* (2013.01)

(58) Field of Classification Search
CPC ..... H05H 1/00; H05H 1/0081; H05H 1/30; H05H 1/36
See application file for complete search history.

(56) References Cited

U.S. PATENT DOCUMENTS 5,225,658 A 7/1993 Yamaguchi et al.
5,717,293 A 2/1998 Sellers
(Continued)

FOREIGN PATENT DOCUMENTS

CN 1149237 5/1997
CN 1177530 5/2003
(Continued)

OTHER PUBLICATIONS

Chinese Office Action dated Aug. 23, 2016 and issued in Chinese Application No. 2016081801551700.
(Continued)

*Primary Examiner* — Thai Pham
(74) *Attorney, Agent, or Firm* — Greenblum & Bernstein, P.L.C.

(57) ABSTRACT

The invention relates to a method and to a control unit for operating the plasma generation apparatus.
The invention is based on a method and a control unit in which a voltage is applied as an ignition voltage between an anode and a cathode for ignition of a plasma.
In order to enable a gentle operation of the plasma generation apparatus it is provided in accordance with the invention that a check is continuously carried out during the ignition process whether the ignition of the plasma has been effected. Additionally, the ignition voltage ($U_Z$) is increased starting from an initial ignition voltage ($U_{Z4}$) and after
(Continued)

recognizing an effected ignition (at the point in time $t_Z$) of the plasma, the voltage is reduced between the anode and the cathode to a maintenance voltage ($U_A$).

20 Claims, 1 Drawing Sheet

(56) References Cited

U.S. PATENT DOCUMENTS

| | | | | |
|---|---|---|---|---|
| 5,982,099 | A * | 11/1999 | Barnes | H05H 1/36 315/111.21 |
| 6,566,625 | B1 | 5/2003 | Hughes | |
| 2005/0109738 | A1 | 5/2005 | Hewett | |
| 2007/0075051 | A1* | 4/2007 | Morrisroe | H05H 1/30 219/121.52 |
| 2015/0069911 | A1* | 3/2015 | Nettesheim | G01F 1/00 315/111.21 |

FOREIGN PATENT DOCUMENTS

| | | |
|---|---|---|
| CN | 201217119 | 4/2009 |
| CN | 201625832 | 11/2010 |
| CN | 102350579 | 2/2012 |
| CN | 202271092 | 6/2012 |
| JP | H01-299771 | 12/1989 |
| JP | H09-148098 | 6/1997 |
| JP | 11-254144 | 9/1999 |
| JP | 2004-237321 | 8/2004 |
| JP | 2011 049103 | 3/2011 |

OTHER PUBLICATIONS

PCT Search Report issued in International Application No. PCT/EP2013/074851.

Japan Office Action conducted in counterpart Japan Appln. No. 2015-544452 (May 19, 2017) (w/ English translation).

* cited by examiner

METHOD AND CONTROL UNIT FOR OPERATING A PLASMA GENERATION APPARATUS

CROSS-REFERENCE TO RELATED APPLICATIONS

The present application is a US National Stage Application of International Application No. PCT/EP2013/074851 filed Nov. 27, 2013 which published as WO 2014/086636 on Jun. 12, 2014. This application also claims the right of priority granted under 35 U.S.C. §§119 and 365 of European Application No. 12195367.3 filed on Dec. 4, 2012.

BACKGROUND OF THE INVENTION

1. Field of the Invention

The invention relates to a method of operating a plasma generation apparatus and to a control unit for operating a plasma generation apparatus.

2. Discussion of Background Information

Plants for the plasma coating of substrates are provided by the applicant, in which a plasma is generated in a so-called plasma torch between an anode and a cathode into which plasma a spray material is injected in powder shape. The plasma arises through the ionization of a gas flowing through between the anode and the cathode which plasma flings the injected powder onto the substrate surface. Such a plasma torch can be viewed as a plasma generation apparatus.

For igniting the plasma, a previously settable number of voltage impulses having a height of several thousand volts and a duration in the millisecond region are applied as an ignition voltage between the anode and the cathode. If the ignition attempt was not successful, then a further attempt is started.

For maintenance of the plasma a constant maintenance voltage significantly smaller with respect to the ignition voltage, for example in the range of approximately 55 to 300 V is applied between the anode and the cathode already before starting the ignition of the plasma.

SUMMARY OF THE INVENTION

In contrast to this it is the object of the invention to provide a method and a control unit for operating a plasma generation apparatus which enable a gentle operation of the plasma generation apparatus.

In accordance with the invention a continuous check is carried out whether the ignition of the plasma has been effected during the ignition process. Additionally, the ignition voltage is increased starting from an initial ignition voltage and after recognizing an effected ignition of the plasma, the voltage between the anode and the cathode is reduced to the maintenance voltage.

The ignition voltage can be configured as a direct voltage, an alternating voltage of arbitrary frequency or as a pulsed direct voltage with arbitrary pulse pause ratios and arbitrary pulse shape.

The mentioned object is also satisfied by a control unit for operating a plasma generation apparatus which is provided for the purpose of applying a maintenance voltage between an anode and a cathode between which a plasma should be formed and for applying an ignition voltage for igniting the plasma between the anode and the cathode. In accordance with the invention it is provided for the purpose of carrying out a continuous check whether the ignition of the plasma has been effected during the ignition process, to increase the ignition voltage starting from an initial ignition voltage and after recognizing an effected ignition of the plasma to reduce the voltage between the anode and the cathode to the maintenance voltage.

Through the method in accordance with the invention and the use of a control unit in accordance with the invention the ignition voltage is only applied for so long as required for the ignition process and moreover also no unnecessarily high ignition voltage is applied, but rather only the actually required ignition voltage is applied for the ignition of the plasma. The application of high voltage impulses can lead to a damage of the plasma generation apparatus, this means, for example of a plasma torch. Such voltage impulses are avoided on use of the method in accordance with the invention or of the control unit in accordance with the invention respectively, so that a damage due to voltage impulses can be avoided and thus a gentle operation of the plasma generation unit is enabled. Moreover, electromagnetic waves are generated by the repeating voltage impulses which can significantly interfere with the operation of electronic devices in the surroundings of the plasma generation apparatus. On use of the method in accordance with the invention and/or of the control unit in accordance with the invention repeating voltage impulses are avoided, so that no or at least no interfering electromagnetic waves are generated.

The plasma generation apparatus is, in particular configured as a plasma torch of a plant for the plasma coating of substrates. However, it can also be a part of an apparatus for light arc welding, plasma cutting, high speed flame spraying, flame wire spraying or flame powder spraying. It is moreover possible to use the plasma generation apparatus for the ignition of combustion processes.

The maintenance voltage is in particular generated by a maintenance voltage source and the ignition voltage is generated by a separate ignition voltage source which are both controlled by a control unit of the plasma generation apparatus. However, it is also possible that only one voltage source is provided which generates both the maintenance voltage and also the ignition voltage.

The maintenance voltage is, in particular applied already before or simultaneously with the ignition process.

For the checking of whether the ignition of the plasma has already been effected, a current flowing, in particular between the anode and the cathode, is measured. In this connection, in particular a so-called ignition current can be measured, this means a current which flows due to the ignition voltage. As long as no plasma has been formed between the anode and the cathode, the anode and the cathode are electrically isolated from one another. Through the ionization of the gas between the anode and the cathode charge carriers are set free which enable a current flow between the anode and the cathode. An effected ignition of the plasma is, in particular recognized then when the measured current exceeds a predeterminable current threshold. Additionally, the recognition can still depend on the condition that the mentioned current threshold has to be exceeded for a predeterminable time span without interruption.

As soon as it was recognized that the ignition of the plasma has been effected the ignition voltage is no longer increased, but rather reduced to the maintenance voltage. The reduction takes place, in particular abrupt after the recognition of the ignition. However, it is also possible that the ignition voltage is reduced along a pre-determinable extent.

The initial ignition voltage, in particular amounts to 0 V, however, it can also have a different value.

The ignition voltage is increased for the ignition of the plasma, in particular increasing in a strongly monotonous manner. The increase, in particular takes place for a constant gradient, which can, for example, amount to between 100 V/ms and 10000 V/ms. However, it is also possible that the ignition voltage is increased in a different kind and manner, for example, it can be increased stepwise.

In an embodiment of the invention the ignition voltage is applied by an ignition device which is separated after an effected ignition of the anode and/or the cathode. The separation, in particular takes place by opening one or two switches which are arranged between the ignition device and the anode and/or the cathode. The mentioned switches are, in particular also controlled by the said control unit of the plasma generation apparatus. Through the separation of the ignition device form the anode and/or the cathode no interfering interaction between the ignition device and the other components of the plasma generation apparatus can be brought about.

In an embodiment of the invention an identification parameter is associated with the used anode-cathode-pair and the ignition of the plasma is carried out in dependence on the identification parameter. In this way the ignition can be adjusted with respect to the currently present anode-cathode-pair, this means for example adjusted to the currently present plasma torch. For example, an adjusted initial ignition voltage, an adjusted extent of the ignition voltage on the increase and/or the decrease to the maintenance voltage can be used. The identification parameter, in particular characterizes a plasma torch and can, for example be carried out as a consecutive number or a serial number of the plasma torch. The identification parameter can, in particular be automatically determined, for example, the plasma torch can have an own torch control unit in which the identification parameter is stored and this can be read out by the control unit of the plasma generation apparatus. However, it is also possible that the identification parameter is input by hand into the control unit of the plasma generation apparatus.

In an embodiment of the invention at least one parameter of the extent of the ignition voltage is stored and evaluated up to the effected ignition of the plasma. In particular, a so-called end ignition voltage, this means the ignition voltage at the point of time of recognition of the effected ignition is stored. However, also other parameters, such as, for example, the gradient of the ignition voltage can be stored in a replacement thereof or in addition thereto. Conclusions can be drawn on the state of the plasma generation apparatus from the stored number of sizes. The parameters can, in particular be further processed after the storage. For example, mean values can be calculated or filterings can be carried out.

In particular, the said identification parameter is stored together with the mentioned parameter. In this way the stored parameters can, for example, be used for the adjusted carrying out of the ignition using the described, actually present anode-cathode pair. For this purpose, in particular the identification parameter of the used anode-cathode-pair is determined prior to the ignition of the plasma and the ignition then takes place in dependence on the parameter stored for this anode-cathode pair.

In an embodiment of the invention a timely extent of the stored parameters is evaluated. This should, in particular be understood such that parameters determined and stored for different ignition processes are compared to one another. From the changes of the parameters conclusions can be drawn on the changes of the properties of the plasma generation apparatus.

The changes of the parameters are, in particular determined with reference to an associated comparison value. For this purpose it is monitored whether a currently determined parameter deviates by a pre-determinable degree from the associated comparison value. When this is the case, it can, for example, be concluded that the plasma generation apparatus needs to be checked and possibly whether parts need to be repaired or replaced. For this purpose, a hint can be illustrated or an alarm can be released by the control unit of the plasma generation apparatus. The said degree can, for example, be configured as a pre-determinable absolute boundary, for example, a voltage boundary for the change of the ignition voltage or, for example, be configured as a pre-determinable percentage deviation from the associated comparison value.

The said comparison value can, for example, be determined and stored for a certain type of plasma generation apparatus.

The comparison value can, in particular be determined and stored also from the stored parameters. This comparison value can, for example, be configured as the first determined parameter, this means e.g. the first ignition voltage required for the ignition of the plasma. However, it is also possible, to use, as a comparison value, for example, a mean value of a pre-determinable number of parameters after taking the plasma generation apparatus into use.

The invention also provides for a method of initiating plasma in an apparatus comprising an anode and a cathode, wherein the method comprises spplying a maintenance voltage ($U_A$) between an anode and a cathode, applying an igniting voltage ($U_Z$) between the anode and the cathode in order to cause ignition of plasma, increasing the igniting voltage ($U_Z$) and continuously checking to determine whether the ignition of the plasma has occurred. When ignition of the plasma is determined to have occurred, reducing or stopping the igniting voltage ($U_Z$) so that the voltage between the anode and the cathode is reduced to the maintenance voltage ($U_A$).

In embodiments, the igniting voltage ($U_Z$) increases from a start igniting voltage ($U_{ZA}$).

In embodiments, the start igniting voltage ($U_{ZA}$) is zero volts.

In embodiments, the continuously checking comprises measuring a current flow between the anode and the cathode.

In embodiments, the igniting voltage ($U_Z$) increases monotonically from a start igniting voltage ($U_{ZA}$).

In embodiments, the ignition voltage ($U_Z$) increases at a constant rate from a start igniting voltage ($U_{ZA}$).

In embodiments, the applying the igniting voltage ($U_Z$) comprises applying an increasing igniting voltage via an ignition device.

In embodiments, when ignition of the plasma is determined to have occurred, the ignition device is disconnected from the anode and/or the cathode.

In embodiments, the method further comprises identifying the anode and the cathode prior to the ignition of the plasma.

In embodiments, the method further comprises reading an identification parameter associated with the anode and the cathode prior to the ignition of the plasma.

In embodiments, the method further comprises detecting and storing at least one parameter of the anode and the cathode.

In embodiments, the method further comprises detecting and storing the igniting voltage ($U_Z$) associated with the cathode and the anode.

In embodiments, the method further comprises at least one of storing and evaluating an end igniting voltage ($U_{ZE}$) that is reached upon the ignition of the plasma and detecting an end igniting voltage ($U_{ZE}$) that is reached upon the ignition of the plasma.

In embodiments, the method further comprises prior to the ignition of the plasma, comparing a stored parameter associated with the anode and the cathode.

In embodiments, the method further comprises comparing a stored parameter associated with the anode and the cathode and controlling the maintenance voltage ($U_A$) and/or the igniting voltage ($U_Z$).

In embodiments, the method further comprises identifying the anode and the cathode, comparing a stored parameter associated with the anode and the cathode and controlling the maintenance voltage ($U_A$) and/or the igniting voltage ($U_Z$).

The invention also provides for a plasma initiation control system that comprises a maintenance voltage source connected to and supplying to a maintenance voltage ($U_A$) to an anode and a cathode of a plasma generating apparatus, an ignition voltage source connected to and supplying an igniting voltage ($U_Z$) to the anode and the cathode and a control unit structured and arranged to each of continuously check to determine whether ignition of a plasma has occurred, increase the igniting voltage ($U_Z$) starting from an initial ignition voltage ($U_{ZA}$), and detect the ignition of the plasma and stop or reduce the igniting voltage ($U_Z$).

In embodiments, the maintenance voltage source and an ignition voltage source are separate voltage sources.

The invention also provides for a plasma initiation control system comprising a voltage source connected to an anode and a cathode of a plasma generating apparatus, an ignition voltage source connected to the anode and the cathode, and a control unit connected to the ignition voltage source and being structured and arranged to each of continuously check to determine whether ignition of a plasma has occurred and control the ignition voltage source such that upon detecting the ignition of the plasma, an igniting voltage ($U_Z$) supplied by the ignition voltage source is reduced or stopped.

In embodiments, there is provided a method of initiating plasma using the system described above, wherein the method comprises maintaining a voltage ($U_A$) between an anode and a cathode, during the maintaining, applying an increasing igniting voltage ($U_Z$) between the anode and the cathode, during the applying, continuously checking to determine whether the ignition of the plasma has occurred, and when ignition of the plasma is determined to have occurred, reducing the igniting voltage ($U_Z$) while maintaining the voltage ($U_A$).

Further advantages, features and particulars of the invention result in the following, with reference to the subsequent description of embodiments, as well as with reference to the drawings, in which the same or functionally equal elements are provided with the identical reference numerals.

BRIEF DESCRIPTION OF THE DRAWINGS

In this connection there is shown.

DETAILED DESCRIPTION OF THE INVENTION

Figure 1:
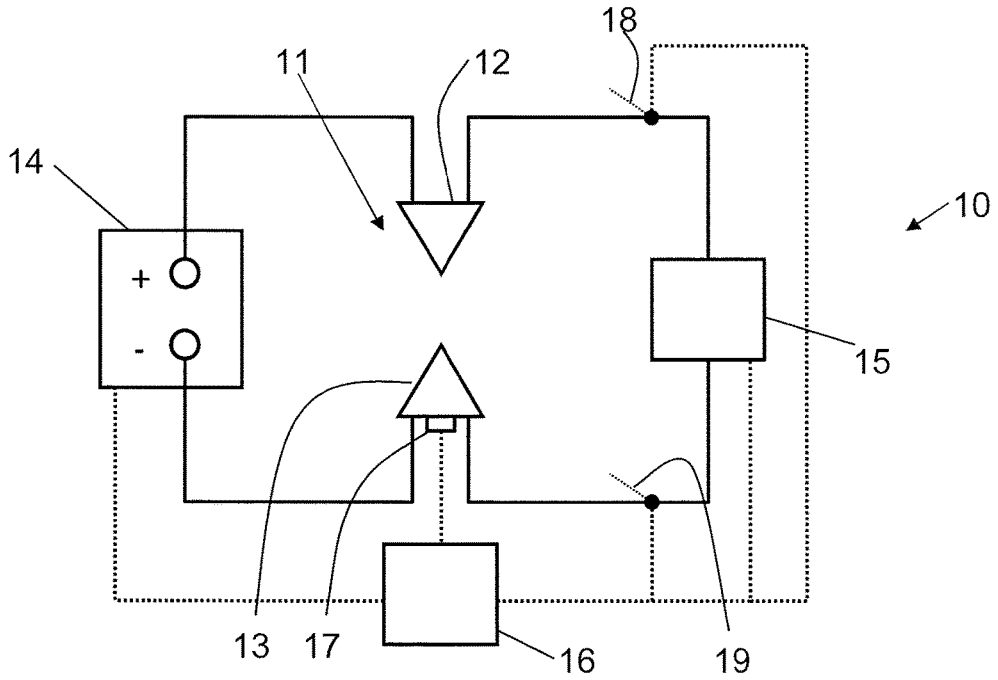
FIG. 1 shows a schematic illustration of a plasma generation unit.

In accordance with FIG. 1, a plasma generation apparatus 10, which can, for example, be configured as a part of a plasma torch of a plant for the plasma coating of substrates, includes an anode-cathode-pair 11 having an anode 12 and a cathode 13 between which a plasma should be formed. On the use of the plasma generation apparatus 10 in a plasma torch a gas flows between the anode 12 and the cathode 13, for example, argon, helium, hydrogen, nitrogen or a mixture thereof, which gas is ionized on the formation of the plasma. For the formation of the plasma either argon or nitrogen is used. Only after an effected ignition other gases are admixed if required.

The anode 12 and the cathode 13 are electrically connected both to a maintenance voltage source 14 and also to an ignition voltage source 15. The maintenance voltage source 14 and the ignition voltage source 15 are controlled by a control unit 16 of the plasma generation apparatus 10. The anode-cathode-pair 11 further has a torch control unit 17 in which, amongst other things an identification parameter in the form of a serial number of the anode-cathode-pair 11 is stored. The torch control unit 17 is in signal communication with the control unit 16, so that the control unit 16 can read out the said serial number and can carry out the control of the maintenance voltage source 14 and/or of the ignition voltage source 15 in dependence of the serial number.

A first switch 18 is arranged between the ignition voltage source 15 and the anode 12 and a second switch 19 is arranged between the ignition voltage source 15 and the cathode 13 by way of which switches the connections between the anode 12 and/or the cathode 13 and the ignition voltage source 15 can be interrupted. The switches 18 and 19 are likewise controlled by the control unit 16.

Figure 2:
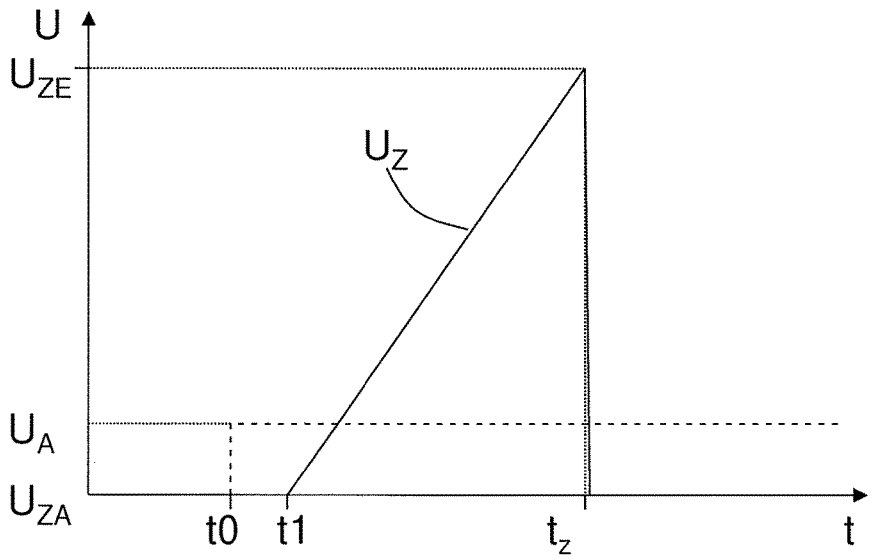
FIG. 2 shows an illustration of voltage extents on igniting a plasma generation apparatus in accordance with FIG. 1.

The extents of an ignition voltage $U_Z$ generated by the ignition voltage source 15 and a maintenance voltage $U_A$ generated by the maintenance voltage source 14 are illustrated on ignition of the plasma in the plasma generation apparatus 10 over time in FIG. 2, wherein the extents are only illustrated qualitatively and not true to scale.

Before the start of the ignition process, the control unit 16 reads the serial number of the anode-cathode-pair 11, this means an identification parameter of the anode-cathode-pair 11, from the torch control unit 17. This information is required, on the one hand, in order to match the course of the ignition process to the currently actually present anode-cathode-pair 11, on the other hand, a parameter of the course of the ignition voltage $U_Z$ is detected up to the effected ignition of the plasma and stored in association with the serial number.

As a preparation of the actual ignition process the constant maintenance voltage $U_A$ is generated at the point in time t0 by the maintenance voltage source 14 which constant maintenance voltage $U_A$ is applied at the anode-cathode-pair 11 and in this way is applied between the anode and the cathode. The maintenance voltage $U_A$ amounts, for example, to approximately 100 V. In as far as the switches 18 and 19 are opened, they are controlled at the point in time t0 such that they are closed and such that the anode-cathode-pair 11 is electrically connected to the ignition voltage source 15.

At the point in time t1, the ignition voltage source 15 starts starting from an initial ignition voltage $U_{ZA}$ of 0 V to generate the ignition voltage $U_Z$, which is applied in addition to the maintenance voltage $U_A$ at the anode-cathode-pair 11 and in this way is applied between the anode and the cathode. The ignition voltage $U_Z$ is increased along a straight line having a constant gradient and in this way is increased increasing in a strongly monotonous manner. The used gradient is, in particular selected in dependence on the above-mentioned serial number of the anode-cathode-pair 11. For this purpose, a table is stored in the control unit 16 in which table the gradient of the ignition voltages are associated with the serial numbers.

Starting from the point in time t1, it is furthermore continuously checked whether the ignition of the plasma has been effected. For this purpose a current flowing over the ignition voltage source 15, a so-called ignition current is measured by way of a, not separately illustrated, current measurement device integrated into the ignition voltage source 15. As soon as the ignition current exceeds a pre-determinable current threshold which likewise can depend on the above-mentioned serial number of the anode-cathode-pair 11 it is concluded that the ignition of the plasma has been effected. This is the case at the point of time $t_Z$ in the FIG. 2. As a consequence thereof, the ignition voltage $U_Z$ is abruptly reduced to 0 V so that then only the maintenance voltage $U_A$ is present between the anode 12 and the cathode 13. Moreover, the switches 18 and 19 are controlled, such that they are electrically separated from the ignition voltage source 15.

The final ignition voltage $U_{ZE}$ is detected by the ignition voltage source 15 and is provided to the control unit 16 which final ignition voltage is generated at the point in time $t_Z$ by the ignition voltage source 15 and in this way is applied between the anode 12 and the cathode 13. The final ignition voltage $U_{ZE}$, for example, amounts to between 6 kV and 21 kV. In this connection it can viewed as a parameter of the extent of the ignition voltage UZ up to the effected ignition of the plasma. The final ignition voltage $U_{ZE}$ is stored in the control unit 16 together with the above-mentioned serial number of the anode-cathode-pair 11.

After the effected ignition of the plasma the control unit 16 evaluates the timely extent of the final ignition voltage $U_{ZE}$. For this purpose, the current end ignition voltage $U_{ZE}$ is compared to a comparison value. When the current end ignition voltage $U_{ZE}$ deviates by a pre-determinable difference value, for example, amounting to between approximately 5 kV and 30 kV, a conclusion is drawn that a problem exists at the current anode-cathode-pair 11, for example, that too strong a wear is present and a corresponding note is illustrated at a non-separately illustrated screen of the control unit 16.

The said comparison value can be fixedly predefined, for example, for a certain type of anode-cathode-pair. The comparison value can also be configured as the first final ignition voltage determined after the first taking into operation of the current anode-cathode-pair or of the plasma generation apparatus. However, it is also possible to use, as a comparison value, a mean value of a pre-determinable number of final ignition voltages after taking into operation of the current anode-cathode-pair or of the plasma generation apparatus.

The invention claimed is:

1. A method of initiating plasma in an apparatus comprising an anode and a cathode, the method comprising:

applying a maintenance voltage between an anode and a cathode;

applying an igniting voltage between the anode and the cathode in order to cause ignition of plasma;

increasing the igniting voltage;

continuously checking to determine whether the ignition of the plasma has occurred; and when ignition of the plasma is determined to have occurred, reducing or stopping the igniting voltage so that the voltage between the anode and the cathode is reduced to the maintenance voltage.

2. The method of claim 1, wherein the igniting voltage increases from a start igniting voltage.

3. The method of claim 2, wherein the start igniting voltage is zero volts.

4. The method of claim 1, wherein the continuously checking comprises measuring a current flow between the anode and the cathode.

5. The method of claim 1, wherein the igniting voltage increases monotonically from a start igniting voltage.

6. The method of claim 1, wherein the ignition voltage increases at a constant rate from a start igniting voltage.

7. The method of claim 1, wherein the applying the igniting voltage comprises applying an increasing igniting voltage via an ignition device.

8. The method of claim 7, wherein, when ignition of the plasma is determined to have occurred, the ignition device is disconnected from the anode and/or the cathode.

9. The method of claim 1, further comprising identifying the anode and the cathode prior to the ignition of the plasma.

10. The method of claim 1, further comprising reading an identification parameter associated with the anode and the cathode prior to the ignition of the plasma.

11. The method of claim 1, further comprising detecting and storing at least one parameter of the anode and the cathode.

12. The method of claim 1, further comprising detecting and storing the igniting voltage associated with the cathode and the anode.

13. The method of claim 1, further comprising at least one of:

storing and evaluating an end igniting voltage that is reached upon the ignition of the plasma; and detecting an end igniting voltage that is reached upon the ignition of the plasma.

14. The method of claim 1, further comprising:

prior to the ignition of the plasma, comparing a stored parameter associated with the anode and the cathode.

15. The method of claim 1, further comprising:

comparing a stored parameter associated with the anode and the cathode; and controlling the maintenance voltage and/or the igniting voltage.

16. The method of claim 1, further comprising:

identifying the anode and the cathode;

comparing a stored parameter associated with the anode and the cathode; and controlling the maintenance voltage and/or the igniting voltage.

17. A plasma initiation control system comprising:

a maintenance voltage source connected to and supplying to a maintenance voltage to an anode and a cathode of a plasma generating apparatus;

an ignition voltage source connected to and supplying an igniting voltage to the anode and the cathode;

a control unit structured and arranged to continuously check to determine whether ignition of a plasma has occurred, increase the igniting voltage starting from an initial ignition voltage, and detect the ignition of the plasma and stop or reduce the igniting voltage.

18. The plasma initiation control system of claim 17, wherein the maintenance voltage source and an ignition voltage source are separate voltage sources.

19. A plasma initiation control system comprising:

a voltage source connected to an anode and a cathode of a plasma generating apparatus;

an ignition voltage source connected to the anode and the cathode;

a control unit connected to the ignition voltage source and being structured and arranged to each of: continuously check to determine whether ignition of a plasma has occurred, and control the ignition voltage source such that upon detecting the ignition of the plasma, an igniting voltage supplied by the ignition voltage source is reduced or stopped.

20. A method of initiating plasma using a plasma initiation control system comprising a voltage source connected to an anode and a cathode of a plasma generating apparatus, an ignition voltage source connected to the anode and the cathode, and a control unit connected to the ignition voltage source, the method comprising:

maintaining a voltage between an anode and a cathode;

during the maintaining, applying an increasing igniting voltage between the anode and the cathode;

during the applying, continuously checking to determine whether the ignition of the plasma has occurred; and when ignition of the plasma is determined to have occurred, reducing the igniting voltage while maintaining the voltage.

* * * * *